US010012396B2

(12) United States Patent
Deivasigamani et al.

(10) Patent No.: US 10,012,396 B2
(45) Date of Patent: Jul. 3, 2018

(54) COMBINED SPACE CONDITIONING OR HEATING AND WATER HEATING SYSTEM

(71) Applicants: Sridhar Deivasigamani, Peoria, IL (US); Sivaprasad Akasam, Dunlap, IL (US)

(72) Inventors: Sridhar Deivasigamani, Peoria, IL (US); Sivaprasad Akasam, Dunlap, IL (US)

(73) Assignee: Intellihot, Inc., Galesburg, IL (US)

( * ) Notice: Subject to any disclaimer, the term of this patent is extended or adjusted under 35 U.S.C. 154(b) by 283 days.

(21) Appl. No.: 14/989,116

(22) Filed: Jan. 6, 2016

(65) Prior Publication Data

US 2016/0320075 A1 Nov. 3, 2016

Related U.S. Application Data

(60) Provisional application No. 62/081,075, filed on Nov. 18, 2014.

(51) Int. Cl.
*F24D 19/10* (2006.01)
*F24D 3/08* (2006.01)
(Continued)

(52) U.S. Cl.
CPC ..... *F24D 19/1066* (2013.01); *F24D 3/08* (2013.01); *F24D 3/082* (2013.01); *F24D 9/00* (2013.01);
(Continued)

(58) Field of Classification Search
CPC ..... F24D 19/1066; F24D 19/00; F24D 3/08; F24D 3/082; F24D 19/1069; F24H 1/48; F24H 1/50; F24H 1/125; F24H 1/122
(Continued)

(56) References Cited

U.S. PATENT DOCUMENTS 1,087,633 A * 2/1914 Blickman ..... F24H 1/205 122/13.01
3,896,992 A * 7/1975 Borovina ..... F24D 3/08 122/20 B
(Continued)

FOREIGN PATENT DOCUMENTS

GB 2253268 A * 9/1992 ..... F24D 11/002
JP 57172134 A * 10/1982 ..... F24H 1/165
(Continued)

*Primary Examiner* — Gregory Huson
*Assistant Examiner* — Daniel E Namay
(74) *Attorney, Agent, or Firm* — Tracy Jong Law Firm; Tracy P. Jong; Cheng Ning Jong

(57) ABSTRACT

A combined space conditioning or heating and fluid heating system includes a main fluid conductor having an inlet and an outlet; a single heating source configured for producing low and high temperature fluid outputs of a fluid input received at the main fluid conductor inlet; a coil comprising an inlet and an outlet; and a supplementary fluid conductor comprising a fluid mover and a directional valve, an inlet and an outlet. The inlet of the main fluid conductor is adapted for connection with the coil outlet. The high temperature fluid output is adapted for connection with the supplementary fluid conductor inlet, the supplementary fluid conductor outlet is adapted for connection with the coil inlet. The low temperature water output is adapted for connection with a fluid delivery point. The water coil inlet is adapted for connection with a raw fluid supply.

6 Claims, 6 Drawing Sheets

(51) Int. Cl.

| | |
|---|---|
| ***F24D 9/00*** | (2006.01) |
| *F24H 1/12* | (2006.01) |
| *F24H 1/48* | (2006.01) |
| *F24H 1/50* | (2006.01) |

(52) U.S. Cl.
CPC ..... *F24D 19/1069* (2013.01); *F24H 1/125* (2013.01); *F24H 1/50* (2013.01)

(58) Field of Classification Search
USPC ..... 237/2 A, 7, 19, 61; 122/13.01
See application file for complete search history.

(56) References Cited

U.S. PATENT DOCUMENTS 4,738,394 A * 4/1988 Ripka ..... F24D 3/08 236/20 R
5,687,908 A * 11/1997 Talbert ..... F24D 3/08 126/101
9,316,402 B2 * 4/2016 Noh ..... F24D 3/08
9,719,687 B2 * 8/2017 Deivasigamani ... F24D 19/1069
2005/0098643 A1 * 5/2005 Guyer ..... F24D 5/02 237/12.1
2006/0022062 A1 * 2/2006 Morris ..... F24D 17/0078 237/19
2007/0205292 A1 * 9/2007 Kwak ..... F23N 1/082 236/21 B
2009/0133641 A1 * 5/2009 Min ..... F24D 19/1066 122/14.3
2009/0173336 A1 * 7/2009 Leifer ..... F24D 11/0257 126/617
2010/0195991 A1 * 8/2010 Deivasigamani ... F24D 17/0026 392/308
2010/0236498 A1 * 9/2010 Komori ..... F24D 3/082 122/19.1
2010/0319378 A1 * 12/2010 Chikami ..... F24D 3/082 62/238.7
2010/0326646 A1 * 12/2010 Kim ..... F24D 17/0031 165/287
2011/0073666 A1 * 3/2011 Jang ..... F24D 3/08 236/12.11
2012/0091214 A1 * 4/2012 Rixen ..... F23N 3/08 237/5
2013/0284116 A1 * 10/2013 Deivasigamani ... F24D 17/0026 122/14.21
2013/0284117 A1 * 10/2013 Deivasigamani ... F24D 17/0026 122/18.1
2014/0229022 A1 * 8/2014 Deivasigamani .... G05D 7/0629 700/282
2015/0090199 A1 * 4/2015 Min ..... F24H 1/52 122/15.1
2015/0204550 A1 * 7/2015 Deivasigamani ... F24D 19/1069 237/2 A
2016/0138829 A1 * 5/2016 Park ..... F24H 1/18 122/14.1
2017/0248325 A1 * 8/2017 Deivasigamani ... F24D 19/1069

FOREIGN PATENT DOCUMENTS

JP 59164845 A * 9/1984 ..... F24D 19/1066
JP 60073240 A * 4/1985 ..... F24D 19/1066
JP 05118652 A * 5/1993
JP 06257770 A * 9/1994
WO WO 9610154 A1 * 4/1996 ..... F24D 3/08

* cited by examiner

COMBINED SPACE CONDITIONING OR HEATING AND WATER HEATING SYSTEM

PRIORITY CLAIM AND RELATED APPLICATIONS

This non-provisional application claims the benefit of priority from provisional application U.S. Ser. No. 62/081,075 filed Nov. 18, 2014. Said application is incorporated by reference in its entirety.

BACKGROUND OF THE INVENTION

1. The Field of the Invention

The present invention is directed generally to a combined space conditioning or heating and water heating system. More specifically, the present invention is directed to a combined space conditioning or heating and water heating system where the space heating system includes a forced air system.

2. Background Art

In conventional space conditioning or cooling systems where forced air ductworks are utilized, purpose-built air conditioning coils and their related control apparatus are provided to remove heat from forced air flows. Such coils are typically used during summer months or when the temperature of a space needs to be lowered. The functioning of the air conditioning coils serves no other purposes than cooling the space. In addition, the entire cooling load is handled using the purpose-built air conditioning coils and their related control apparatus. Tremendous amounts of energy are required to run compressors if the entire cooling load has to be met using conventional air conditioning coils. Further, conventional air conditioning systems are discrete units from water heating systems. There are few to no shared components, causing redundant components, e.g., heat exchangers, fluid conductors and controllers, etc. to be required in discrete conventional space conditioning, heating and water heating systems.

Thus, there is a need for a combined heating or cooling system in which, one or more advantageous heat transfer actions can occur as a matter of normal operation of one of the components of the system.

SUMMARY OF THE INVENTION

In accordance with the present invention, there is provided a combined space conditioning or heating and water heating system including:

(a) a main fluid conductor comprising an inlet and an outlet;

(b) a single heating source configured for producing a low temperature fluid output of a fluid input received at the inlet of said main fluid conductor and producing a high temperature fluid output of the fluid input received at the inlet of the main fluid conductor;

(c) a water coil having an inlet and an outlet; and (d) a supplementary fluid conductor having a fluid mover and a directional valve, an inlet and an outlet, wherein the inlet of the main fluid conductor is adapted for connection with the outlet of the coil, the high temperature fluid output of the main fluid conductor is adapted for connection with the inlet of the supplementary fluid conductor, the outlet of the supplementary fluid conductor is adapted for connection with the inlet of the coil, the low temperature water output is adapted for connection with a fluid delivery point and the inlet of the coil is adapted for connection with a raw fluid supply.

In one embodiment, the single heating source further includes a temperature regulator configured to thermally split a water output into the high temperature output and the low temperature output.

In one embodiment, the temperature regulator is an S-shaped bend.

In one embodiment, the temperature regulator is a loop.

An object of the present invention is to provide a combined space conditioning or heating and water heating system.

Another object of the present invention is to provide a space conditioning or heating and water heating system having only one heating source.

Another object of the present invention is to provide a space conditioning system which takes advantage of an incoming flow of cold water that is requested from a water supply.

Another object of the present invention is to provide a space conditioning system which takes advantage of recirculated water within the system.

Another object of the present invention is to provide a space conditioning system which reduces the load exerted on a conventional air coil cooling system.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

PARTS LIST

2—combined space conditioning or heating and water heating system
4—heat exchanger
6—buffer tank
8—pump
9—main fluid conductor
10—outlet
12—inlet
14—point of use or fluid delivery point
16—solenoid valve
18—blower
20—wall
22—incoming water manifold
24—mobile device
26—cloud computing
28—thermostat
30—S-shaped bend or temperature regulator
31—loop or temperature regulator
32—thermostatic valve
34—pump
36—check valve
38—furnace
40—first heat transfer coil
42—air conditioning coil
44—supplementary fluid conductor
46—valve
48—second heat transfer coil
50—connection point

PARTICULAR ADVANTAGES OF THE INVENTION

Bacterium *Legionella pneumophila*, the cause for Legionnaires' disease, thrives in stagnant potable water. In the present system, potable water is moved significantly more frequently than conventional space and water heating systems, thereby reducing the possibility for transmission of Legionnaires' disease due to potable water tainted with bacterium *Legionella pneumophila*.

The present system includes a two-temperature circuit, where in one instance, a higher temperature fluid is used in space (air) heating and the other instance, a lower temperature fluid is used in water heating. By having two fluids at two different temperatures, air heating can be carried out more efficiently (using fluid disposed at higher temperature) while excessively hot water at points of use can be avoided. The present system provides two-temperature circuits at two different temperatures using only one heater.

The present system is combined and therefore eliminates the need for discrete units required for space conditioning or heating and water heating, saving physical space that is otherwise required to accommodate discrete units. In contrast to discrete units, the present system further simplifies installation as only one unit is required to be installed to provide space conditioning or heating and water heating. In a space conditioning mode, when water is drawn through a water coil of the furnace due to a water request, the air forced through the space conditioning device is cooled. In one embodiment, when a cold water request exists, cold water is drawn through a water coil disposed in the ductworks of the furnace before reaching a cold water output. When a hot water request exists, cold water is drawn through a water coil disposed in the ductworks of the furnace before reaching a heater having a heat exchanger and subsequently a hot water output. If hot water is not desired, it is also possible to recirculate the volume of water still left in the system such that heat can be rejected into the water volume at the water coil which is subsequently rejected in the surroundings of the heat exchanger through the heat exchanger provided that the heat exchanger is not also in use for supplying hot water.

DETAILED DESCRIPTION OF A PREFERRED EMBODIMENT

Figure 1:
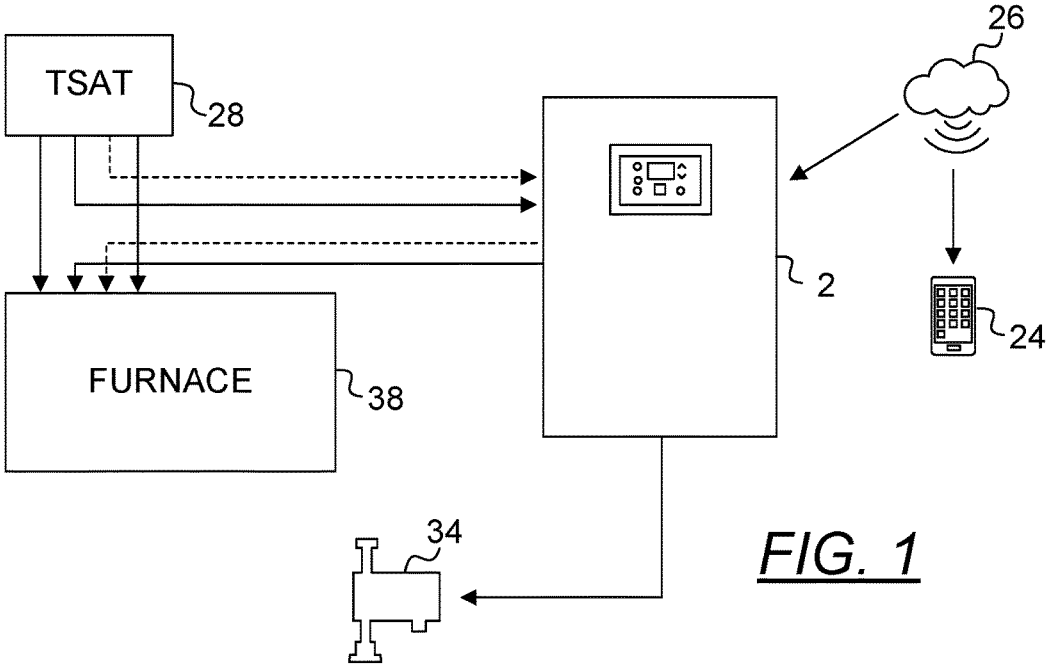
FIG. 1 is a diagram depicting the interconnections of the present combined space conditioning or heating and water heating system with a thermostat and a mobile device.
Figure 2:
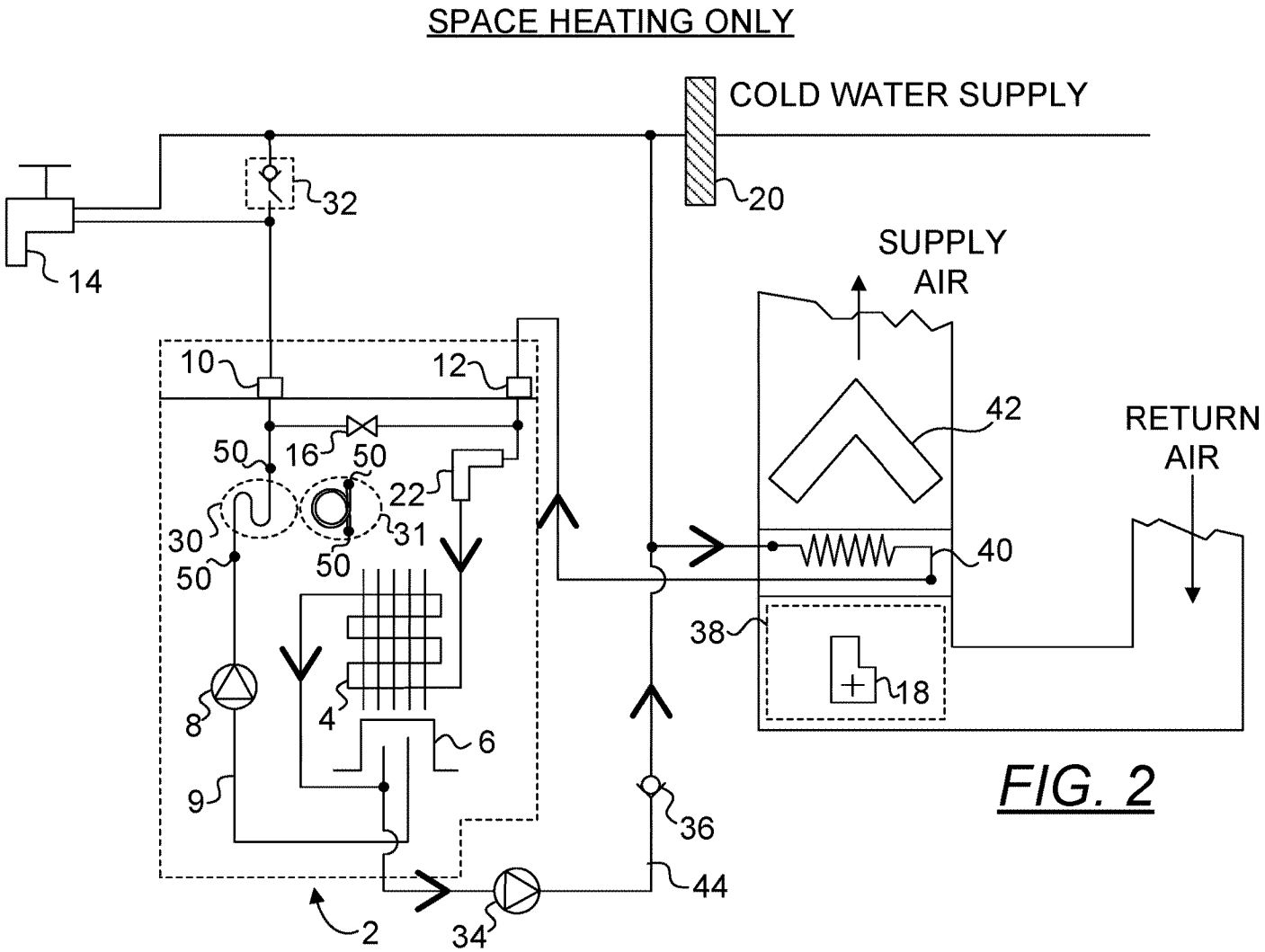
FIG. 2 is a diagram depicting one embodiment of the present combined space conditioning or heating and water heating system when used for space heating only.

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower). FIG. 1 is a diagram depicting the interconnections of the present combined space conditioning or heating and water heating system with a thermostat and a mobile device. Disclosed herein is a combined system 2 operably connected to a fluid mover or pump 34 either externally disposed from the combined system 2 or included as part of the combined system 2. The pump 34 is fluidly disposed in a fluid conductor connecting an output and an input of the combined system 2. FIG. 2 is a diagram depicting one embodiment of the present combined space conditioning or heating and water heating system when used for space heating only. A heat transfer coil 40 is provided in an existing forced air ductwork of a furnace 38 or a purpose built forced air ductwork where forced air is produced by a blower and the heat transfer coil 40 is disposed downstream from the blower within the ductwork. In some embodiments, one or more existing air conditioning coils may be used in addition to the heat transfer coil 40. When used in conjunction with air conditioning coils, the heat transfer coil 40 reduces the amount of heat that needs to be removed from the air within the ductworks of the furnace to achieve a cooling setpoint. A thermostat 28 is operably connected to the combined system 2 and the furnace 38. In the embodiment shown, a controller of the combined system 2 is further configured to communicate with one or more mobile devices 24 via cloud computing 26. Therefore, armed with a mobile device, a user of the present system is able to control the system from any location where the mobile device is connected to cloud computing 26.

The combined system 2 includes an inlet 12 configured for receiving an input flow, an outlet 10 configured for outputting a heated flow, a heat exchanger 4 for receiving heat from a single heating source, e.g., a burner, an electric heating coil, or a combination thereof, and transferring it to the fluid flowing within the heat exchanger 4, a buffer tank 6 for temporarily storing a small volume of fluid which helps to ease temperature fluctuations in hot fluid delivery and a solenoid valve 16 which controls the recirculation flow of the combined system 2. In one embodiment not shown, a buffer tank is not used. In one example, the temperature of the high temperature output is about 180 degrees F. while the temperature of the low temperature output is about 120 degrees F. An incoming fluid manifold 22 which includes, among other devices, a flowmeter adapted to record the flowrate of the incoming fluid flow, a temperature sensor adapted to record the temperature of the incoming fluid flow, is provided.

Referring to FIG. 2, in this mode, incoming raw or unheated fluid (e.g., water) is brought into a building through a wall 20 and is subsequently heated in the heat exchanger 4 functionally connected to a heating source of the main fluid conductor 9 within the combined system 2. The heated flow is then recirculated by pump 34 via supplementary fluid conductor 44 external of the combined system 2. Pump 34 and heat transfer coil 40 are located within fluid conductor 44. Heat transfer from the liquid flowing through heat transfer coil 40 into the air of the ductwork of the furnace 38 is enhanced via convection as the blower 18 of the furnace is turned on. A temperature regulator 30 separates the output of the heater into a high temperature output, i.e., the portion of the flow after the heat exchanger 4 and a low temperature output which is disposed downstream from the temperature regulator 30. In one embodiment, the temperature regulator is an S-shaped bend 30. In another embodiment, the temperature regulator is a loop 31.

Figure 3:
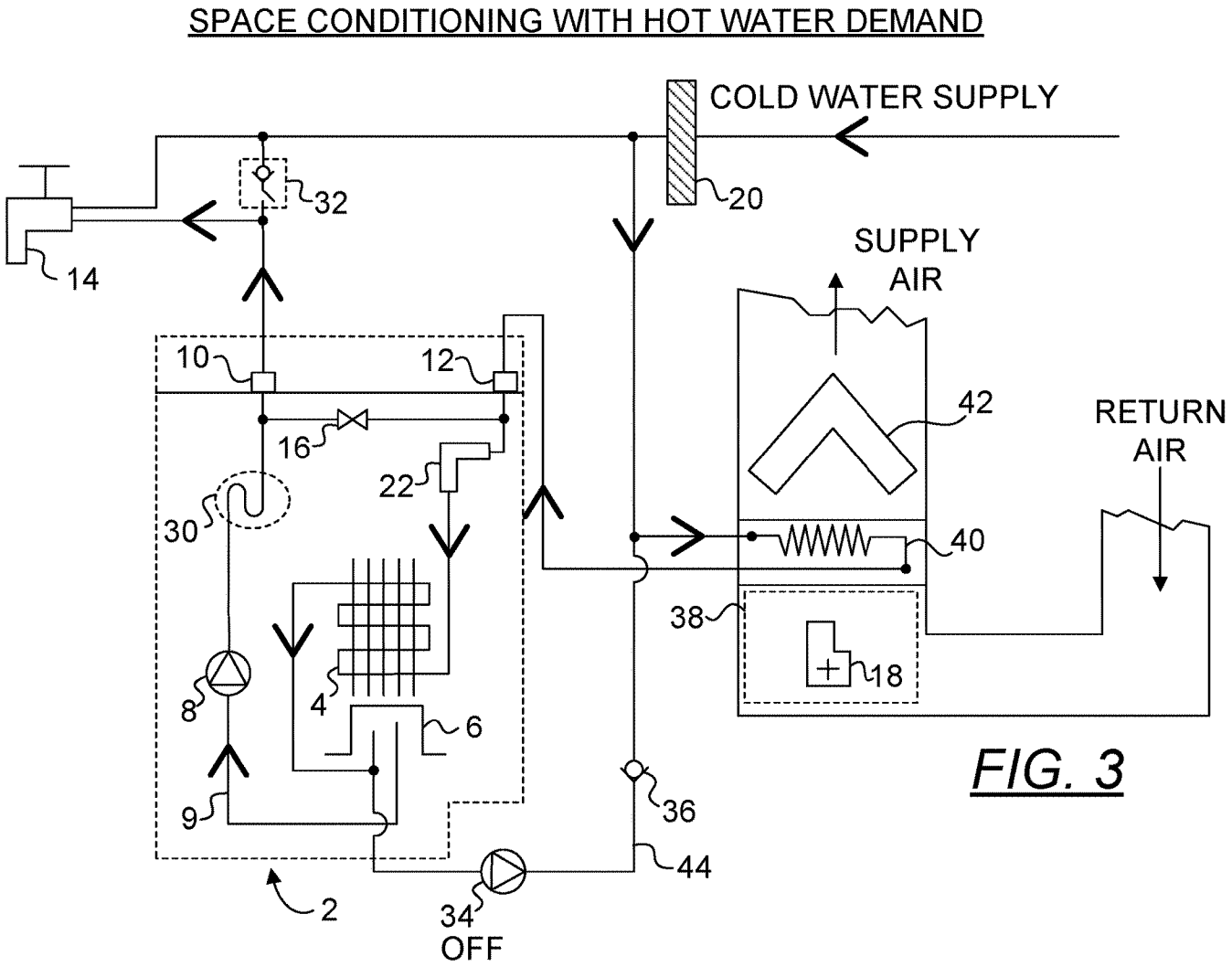
FIG. 3 is a diagram depicting one embodiment of the present combined space conditioning or heating and water heating system when used for space conditioning or cooling and supplying hot water.

FIG. 3 is a diagram depicting one embodiment of the present combined space conditioning or heating and water heating system when used for space conditioning and supplying hot water. In this mode, as pump 34 is not activated and a check valve 36 is arranged to prevent flow in the direction opposite that of the flow through pump 34, no flow is available through fluid conductor 44. Instead, the heated liquid exits the combined system 2 to the point of use 14. Although the demand calls for heated water, no heated water is configured to flow through heat transfer coil 40. The cold water flow through the heat transfer coil 40 is therefore capable of removing heat from the air space in the ductwork of the furnace 38. In some instances, heat transfer coil 40 may reduce the load of a compressor operably coupled with a co-functioning air conditioning coil 42 by as much as about 15% to 35%.

Figure 4:
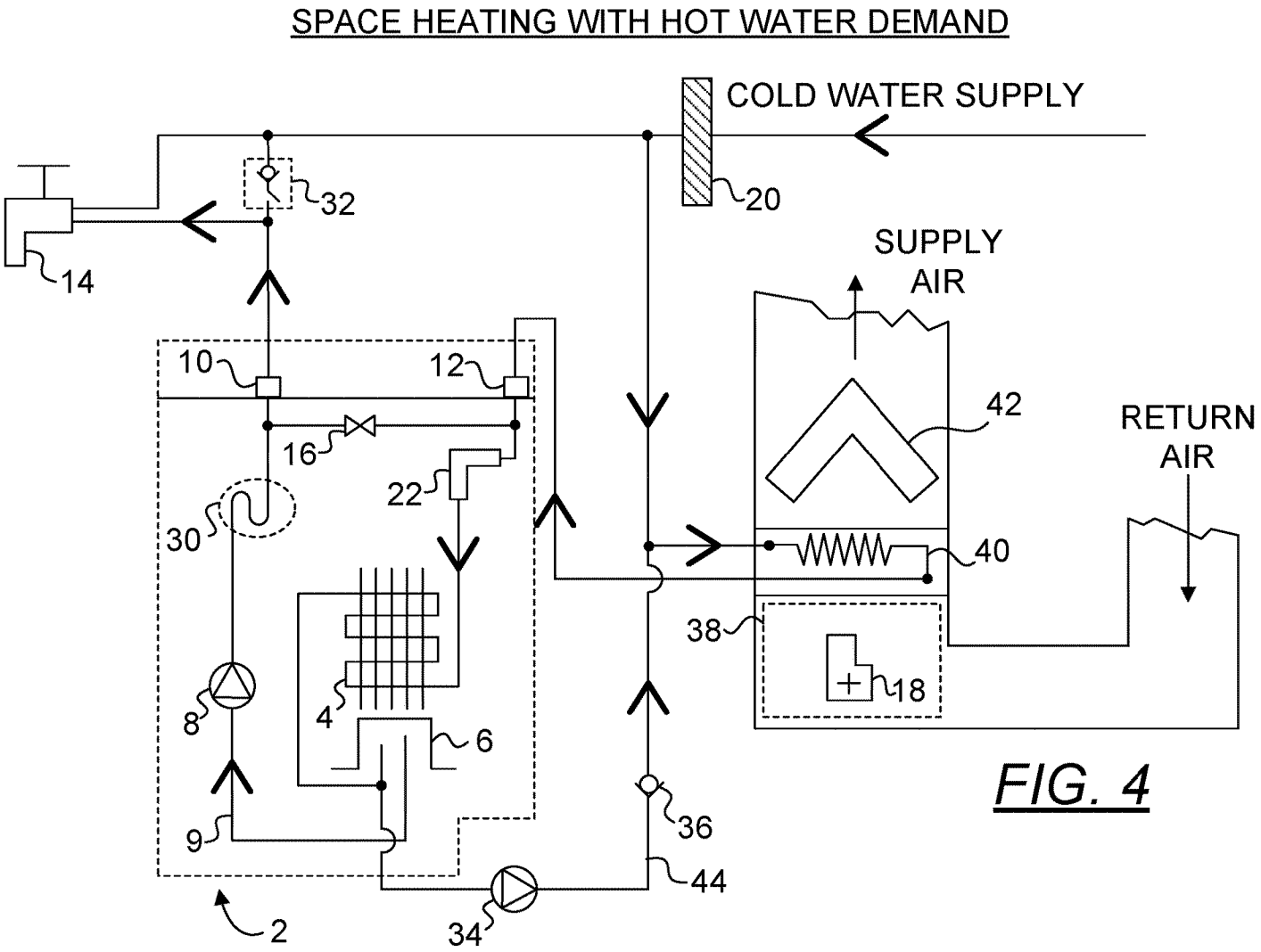
FIG. 4 is a diagram depicting one embodiment of the present combined space conditioning or heating and water heating system when used for space heating and supplying hot water.

FIG. 4 is a diagram depicting one embodiment of the present combined space conditioning or heating and water heating system 2 when used for space heating and supplying hot water. It shall be noted that, in this mode, pump 34 is enabled while cold water continues to be drawn. However, the pump speed is modulated such that the flow through the supplementary fluid conductor 44 is maintained at such pressure that it does not overcome the cold incoming water into the heat transfer coil 40 but co-flows with the cold water. The flow going into the water coil is then composed of a mixture of heated water and unheated water. The overall temperature of the mixture flow is lower than the heated water from the heat exchanger 4 but higher than the cold water prior to the formation of the mixture. Therefore, space heating via heat transfer coil 40 will not be as effective as the case where the space heating alone is requested, i.e., without a hot water demand as well as shown in FIG. 2.

Figure 5:
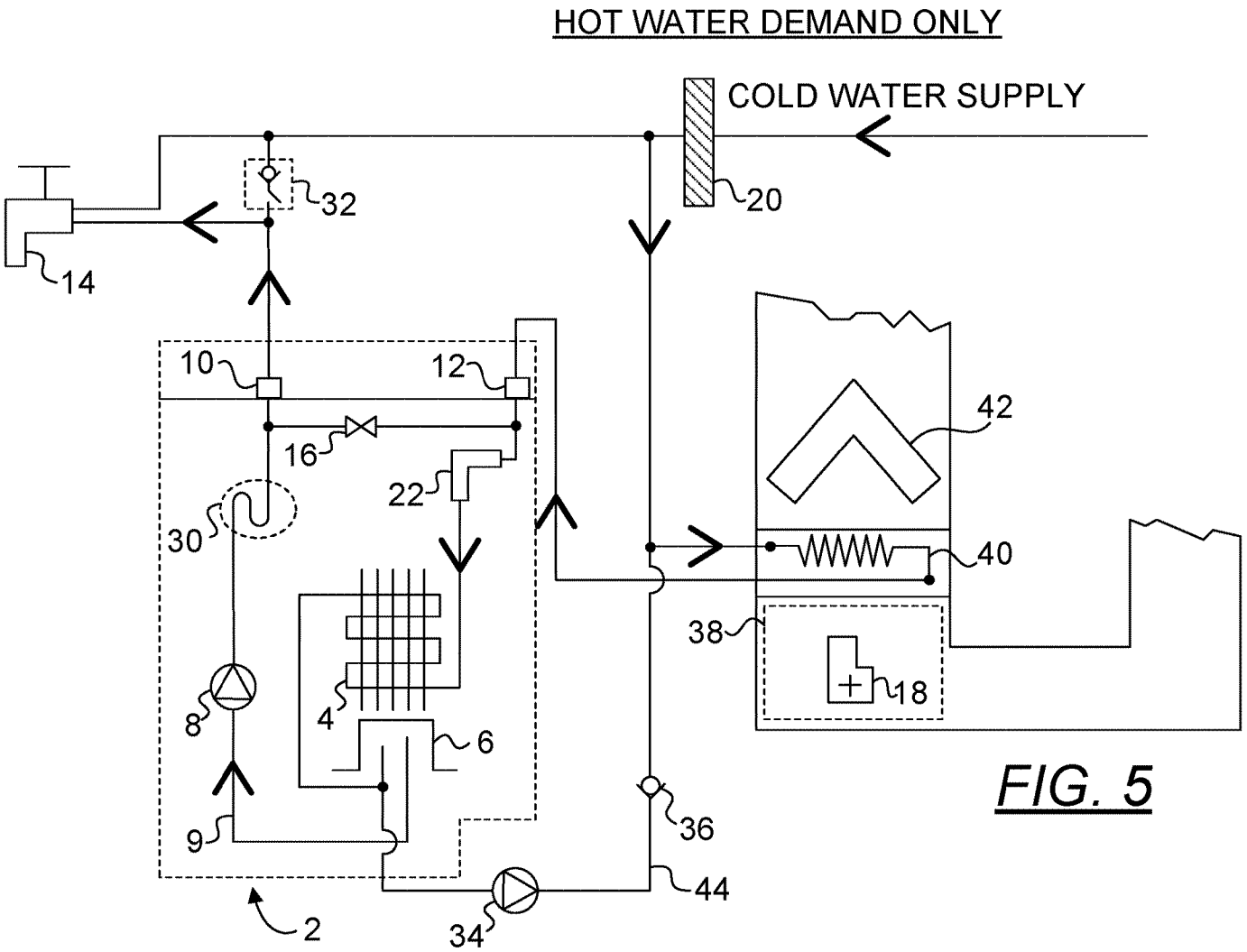
FIG. 5 is a diagram depicting one embodiment of the present combined space conditioning or heating and water heating system when used for supplying hot water only.

FIG. 5 is a diagram depicting one embodiment of the present combined space conditioning or heating and water heating system 2 when used for supplying hot water only. When hot water is requested at the point of use 14, cold water is drawn through the heat transfer coil 40 and heated in the heat exchanger 4 before getting delivered at the point of use 14. As space heating or conditioning is not required, the flow of cold water through the heat transfer coil 40 does not adversely affect space air heating or conditioning.

Figure 6:
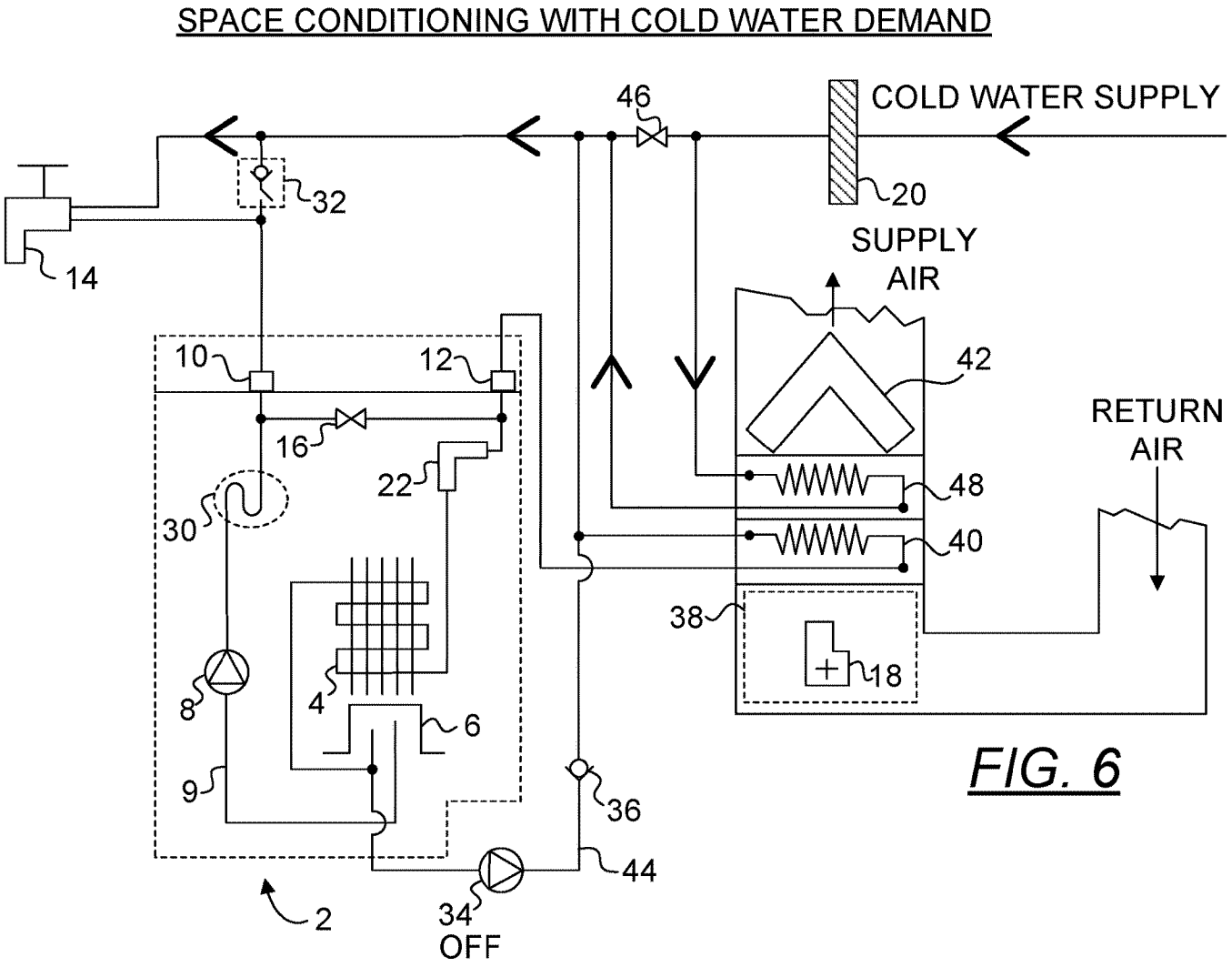
FIG. 6 is a diagram depicting one embodiment of the present combined space conditioning or heating and water heating system when used for space conditioning and supplying unheated water.

FIG. 6 is a diagram depicting one embodiment of the present combined space conditioning or heating and water heating system 2 when used for space conditioning and providing unheated water. In this embodiment, an additional heat transfer coil 48 is provided. Upon receiving a request at the point of use for cold water, cold water is drawn though the heat transfer coil 40, before continuing in its path to the point of use 14. In another example, if the operation of the heater is not required, pump 8 may alternatively be turned on to move water through the heat transfer coil 40, removing heat from the space in the ductwork and at least a portion of the obtained heat in the fluid flow is then rejected from the fluid while flowing through the heat exchanger 4. A valve 46, e.g., solenoid valve is provided to selectively channel the cold water flow through the heat transfer coil 48. When valve 46 is closed the incoming flow is drawn through the heat transfer coil 48. When valve 46 is open, the incoming flow is drawn mostly through valve 46 as the pressure drop exerted by the heat transfer coil 48 is much greater than the pressure drop caused by an open valve 46.

In configurations where no flow has been effected through the supplementary fluid conductor 44 for an extended period of time, pump 34 is exercised to cause a flow through supplementary fluid conductor 44 to avoid stagnant water collection within the present combined system.

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and changes may be made without departing from the scope of the disclosed embodiments. The various embodiments can be combined with one or more other embodiments to form new embodiments. The detailed description is, therefore, not to be taken in a limiting sense, and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

What is claimed herein is:

1. A combined space conditioning or heating and fluid heating system comprising:

(a) a main fluid conductor comprising an inlet and an outlet;

(b) a single heating source for producing a heated fluid flow output at said inlet of said main fluid conductor;

(c) a first coil comprising an inlet and an outlet;

(d) a supplementary fluid conductor comprising a fluid mover and a directional valve, an inlet and an outlet, wherein said directional valve allows at least a portion of said heated fluid flow output from said inlet of said supplementary fluid conductor to said outlet of said supplementary fluid conductor; and (e) a temperature regulator, comprising one of an S-shaped bend and a loop, for thermally splitting said heated fluid flow output into a high temperature fluid output and a low temperature fluid output, wherein said inlet of said main fluid conductor is connected with said outlet of said first coil, said high temperature fluid output of said main fluid conductor is connected with said inlet of said supplementary fluid conductor, said outlet of said supplementary fluid conductor is connected with said inlet of said first coil, said low temperature fluid output is connected with a fluid delivery point and said inlet of said first coil is connected with a raw fluid supply.

2. The combined space conditioning or heating and fluid heating system of claim 1, wherein said temperature regulator is an S-shaped bend.

3. The combined space conditioning or heating and fluid heating system of claim 1, wherein said temperature regulator is a loop.

4. The combined space conditioning or heating and fluid heating system of claim 1, further comprising a blower configured to selectively cause air flow surrounding said first coil.

5. The combined space conditioning or heating and fluid heating system of claim 1, further comprising a second coil adapted for connection in parallel with the raw fluid supply and a valve adapted to selectively cause diversion of the raw fluid supply through the second coil.

6. The combined space conditioning or heating and fluid heating system of claim 1, wherein the raw fluid supply is water supply.

* * * * *